US010168650B2

(12) United States Patent
Soeda

(10) Patent No.: US 10,168,650 B2
(45) Date of Patent: Jan. 1, 2019

(54) FIXATION DEVICE AND IMAGE FORMING APPARATUS

(71) Applicant: Oki Data Corporation, Tokyo (JP)

(72) Inventor: Teruo Soeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/817,757

(22) Filed: Nov. 20, 2017

(65) Prior Publication Data

US 2018/0150002 A1 May 31, 2018

(30) Foreign Application Priority Data

Nov. 29, 2016 (JP) ..... 2016-231128

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2075; G03G 2215/2093
See application file for complete search history.

(56) References Cited

U.S. PATENT DOCUMENTS

2014/0241763 A1* 8/2014 Proffitt ..... G03G 15/2025 399/325
2015/0198919 A1* 7/2015 Lee ..... G03G 15/2075 399/329
2017/0219969 A1* 8/2017 Umeda

FOREIGN PATENT DOCUMENTS

JP 2012-234147 A 11/2012

* cited by examiner

*Primary Examiner* — Sophia S Chen
(74) *Attorney, Agent, or Firm* — Metrolexis Law Group, PLLC

(57) ABSTRACT

A fixation device according to an embodiment includes: a belt member having a tubular shape with an inner circumferential surface and an outer circumferential surface, and provided to be rotatable; a heating member arranged to face the inner circumferential surface of the belt member; a lubricant supply device including a lubricant holding member that includes a lubricant holding portion that holds a lubricant, an outer surface, and at least one passage extending from the lubricant holding portion to the outer surface, and a lubricant pressurizing member that pressurizes the lubricant held in the lubricant holding portion; and a rotational member provided to be capable of contacting and rotating with the outer circumferential surface of the belt member.

9 Claims, 9 Drawing Sheets

FIXATION DEVICE AND IMAGE FORMING APPARATUS

CROSS REFERENCE TO RELATED APPLICATIONS

This application claims priority based on 35 USC 119 from prior Japanese Patent Application No. 2016-231128 filed on Nov. 29, 2016, entitled "FIXATION DEVICE AND IMAGE FORMING APPARATUS", the entire contents of which are incorporated herein by reference.

BACKGROUND

The disclosure relates to a fixation device and an image forming apparatus including the fixation device.

Image forming apparatuses have been proposed which include a fixation device to fuse a developer image onto a medium using a belt (see Patent Document 1, for example). In such a fixation device, grease is provided between the belt and a heater in contact with the belt.

Patent Document 1: Japanese Patent Application Publication No. 2012-234147

SUMMARY

The image forming apparatus like this has a potential to form a high-quality image, for example, by performing a fixation operation while applying stable pressure to the medium through the belt.

For this reason, it is desirable to provide a fixation device and an image forming apparatus that are suitable to achieve a higher-quality image.

A first aspect is a fixation device that includes: a belt member having a tubular shape with an inner circumferential surface and an outer circumferential surface, and provided to be rotatable; a heating member arranged to face the inner circumferential surface of the belt member; a lubricant supply device including a lubricant holding member that includes a lubricant holding portion that holds a lubricant, an outer surface, and at least one passage extending from the lubricant holding portion to the outer surface, and a lubricant pressurizing member that pressurizes the lubricant held in the lubricant holding portion; and a rotational member provided to be capable of contacting and rotating with the outer circumferential surface of the belt member.

A second aspect is an image formation apparatus including the fixation device according to the first aspect.

According to the aspect(s), in the lubricant supply device, the lubricant held in the lubricant holding member is pressurized by the lubricant pressuring member. Thereby, the lubricant is supplied to a clearance between the inner circumferential surface of the belt member and the heating member via the passage. Because of the structure that makes the lubricant less likely to be exposed to the outside while in an assembling process, the fixation device is easy to handle. In addition, while in operation, an appropriate amount of lubrication agent is supplied to the clearance between the inner circumferential surface of the belt member and the heating member.

Accordingly, the fixation device is suitable to achieve a higher-quality image. This is because the existence of the appropriate amount of lubricant enables the belt member to rotate smoothly. It should be noted that: the above effect is one example of the effects obtainable from the aspect(s); and effects of the invention are not limited to the above.

DETAILED DESCRIPTION

Figure 1A:
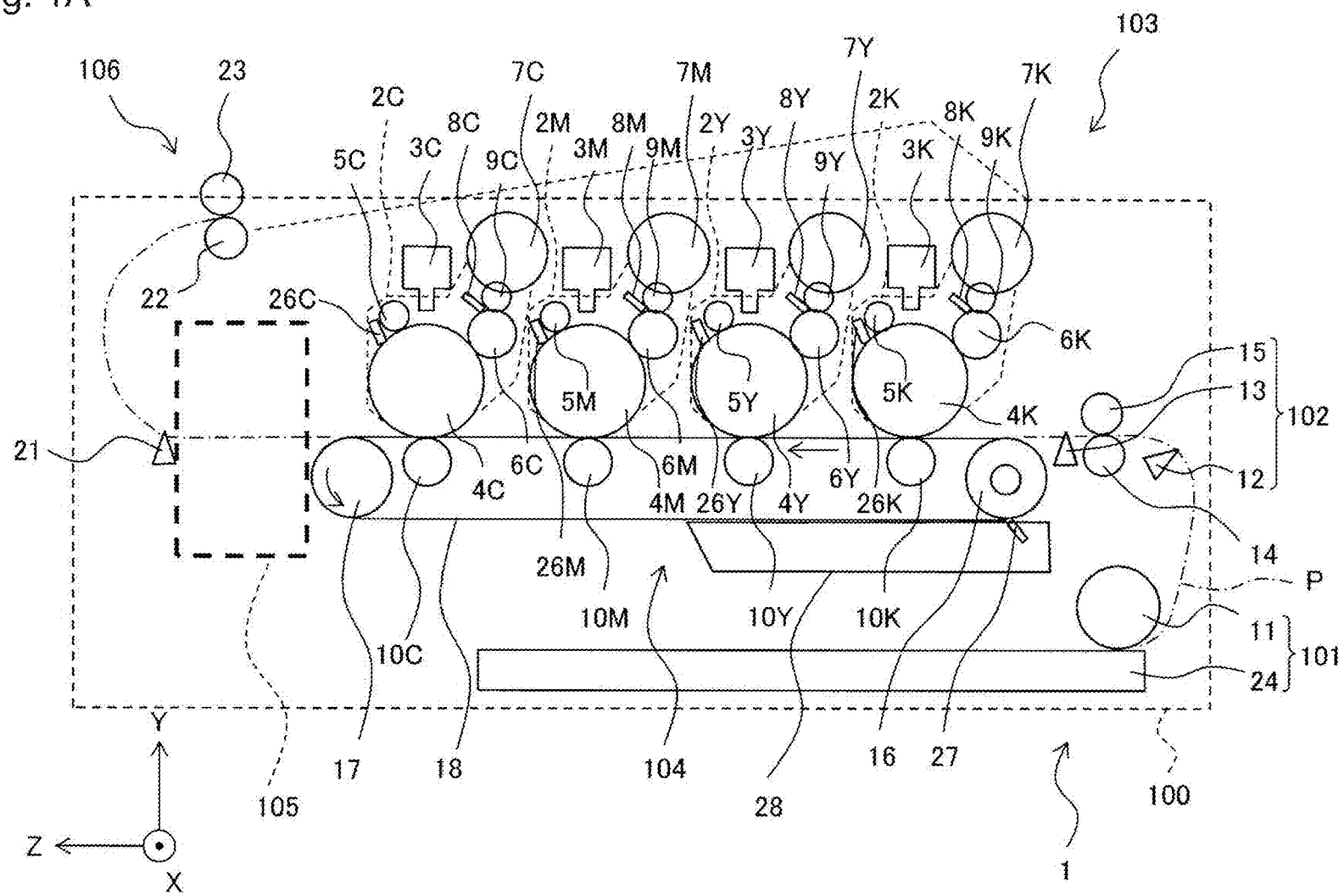
FIG. 1A is a schematic view illustrating an example of an overall configuration of an image forming apparatus according to one or more embodiments.

Embodiments are hereinbelow explained in detail with reference to the drawings. Incidentally, the following discussion is intended to exemplify the invention, but not to limit the invention to the below-discussed embodiment. Furthermore, the components included in the invention, their placements or dimensions, or dimensional ratios among them are not limited to those illustrated in the drawings.

<1. Embodiments>

[Schematic Configuration of Image Forming Apparatus 1]

Figure 1B:
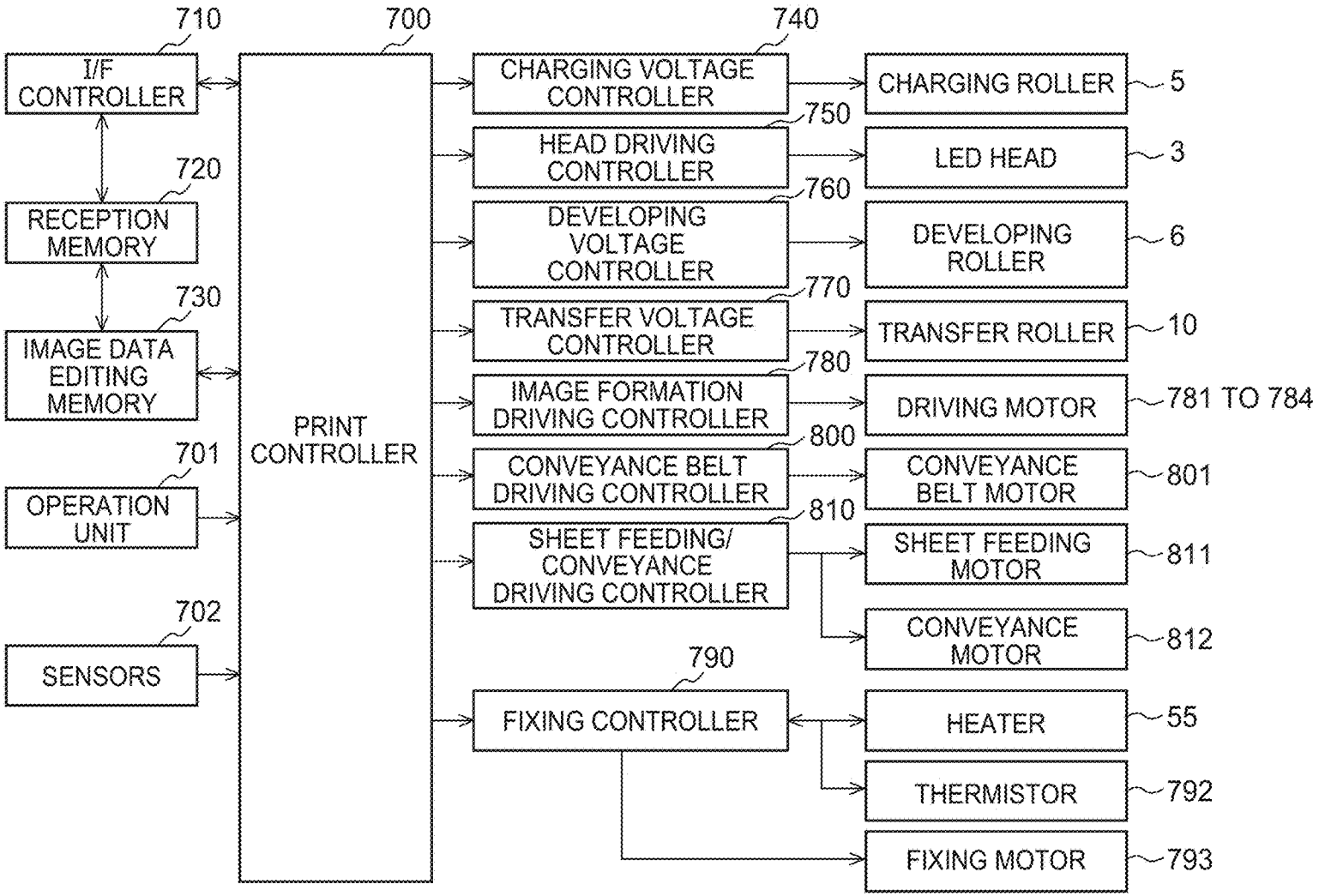
FIG. 1B is a block diagram schematically illustrating an example of an internal configuration of the image forming apparatus illustrated in FIG. 1A.

FIG. 1A is a schematic view illustrating an example of an overall configuration of an image forming apparatus 1 in which a fixation device 105 or a fusing device according to an embodiment is installed. FIG. 1B is a block diagram illustrating an internal configuration of the image forming apparatus 1 illustrated in FIG. 1A. The image forming apparatus 1 is an electrophotographic printer that forms an image (for example, a color image) on a record medium (referred to as a print medium or a transfer member as well) such as a paper sheet. Incidentally, in this specification, a widthwise direction is defined as a direction orthogonal to a direction of conveying the record medium (an X-axis direction or a direction orthogonal to a sheet of paper on which FIG. 1A is drawn). Furthermore, as discussed later, a Z-axis direction is defined as a direction of conveying the record medium inside the fixation device 105, and a Y-axis direction is defined as a height direction orthogonal to both the X- and Y-axis directions.

The image forming apparatus 1 includes, for example, a sheet feeder 101, a medium conveyance unit 102, an image forming section 103, a transfer unit 104, a fixation device 105, and a delivery unit 106.

(Sheet Feeder 101)

The sheet feeder 101 includes, for example, a sheet cassette (sheet feeding tray) 24, and a sheet feeding roller 11. The sheet cassette 24 accommodates record media. The sheet feeding roller 11 is a member which picks up the record media one by one from the sheet cassette 24, and feeds the record media to the medium conveyance unit 102.

(Medium Conveyance Unit 102)

The medium conveyance unit 102 includes, for example, a position sensor 12, a pair of conveyance rollers 14, 15 arranged to face each other, and a position sensor 13 in order from the upstream. The position sensors 12, 13 detect the position of a record medium travelling on a conveyance passage P. The pair of conveyance rollers 14, 15 convey the record medium, supplied by the sheet feeding roller 11, to the image forming section 103 arranged downstream of the conveyance rollers 14, 15.

(Image Forming Section 103)

The image forming section 103 forms toner images (developer images). The transfer unit 104 transfers the toner images, formed in the image forming section 103, onto the record medium. The image forming section 103 includes, for example, four image forming units 2K, 2Y, 2M, 2C. The image forming units 2K, 2Y, 2M, 2C, respectively, include light emitting diode (LED) heads 3K, 3Y, 3M, 3C, photoconductor drums 4K, 4Y, 4M, 4C, charging rollers 5K, 5Y, 5M, 5C, developing rollers 6K, 6Y, 6M, 6C, toner tanks 7K, 7Y, 7M, 7C, developing blades 8K, 8Y, 8M, 8C, toner supplying sponge rollers 9K, 9Y, 9M, 9C, and photoconductor blades 26K, 26Y, 26M, 26C.

The LED heads 3K, 3Y, 3M, 3C expose the surfaces of the photoconductor drums 4K, 4Y, 4M, 4C facing the LED heads 3K, 3Y, 3M, 3C, and thereby form electrostatic latent images on the surfaces of the photoconductor drums 4K, 4Y, 4M, 4C.

The photoconductor drums 4K, 4Y, 4M, 4C are column-shaped members that carry the electrostatic latent images on their surfaces (surface layer portions), and are made of a photoconductor (for example, an organic photoconductor).

The charging rollers 5K, 5Y, 5M, 5C are members (electrically-charging members) that electrically charge the surfaces (surface layer portions) of the photoconductor drums 4K, 4Y, 4M, 4C, and are arranged in contact with the surfaces (circumferential surfaces) of the photoconductor drums 4K, 4Y, 4M, 4C.

The developing roller 6K, 6Y, 6M, 6C are members that carry toners for developing the electrostatic latent images on their surfaces, and are arranged in contact with the surfaces (circumferential surfaces) of the photoconductor drums 4K, 4Y, 4M, 4C.

The toner tanks 7K, 7Y, 7M, 7C accommodate the toners in their insides, and include toner discharging ports in their lower portions.

The developing blades 8K, 8Y, 8M, 8C are toner restricting members which form layers of the toners (toner layers) on the surfaces of the revolving developing roller 6K, 6Y, 6M, 6C, and which restrict (control, or adjust) the thicknesses of the toner layers. The developing blades 8K, 8Y, 8M, 8C are, for example, plate-shaped elastic members (leaf springs) made of stainless steel or the like. The distal end portions of the plate-shaped elastic members are arranged near the surfaces of the developing roller 6K, 6Y, 6M, 6C.

The toner supplying sponge rollers 9K, 9Y, 9M, 9C are members (supply members) that supply the respective toners to the developing roller 6K, 6Y, 6M, 6C, and are arranged in contact with the surfaces (circumferential surfaces) of the developing roller 6K, 6Y, 6M, 6C.

The photoconductor blades 26K, 26Y, 26M, 26C are cleaning members that clean the surfaces of the photoconductor drums 4K, 4Y, 4M, 4C by scraping and thereby collecting toners remaining on the surfaces (surface layer portions) of the photoconductor drums 4K, 4Y, 4M, 4C. The photoconductor blades 26K, 26Y, 26M, 26C are arranged counter to, and in contact with, the surfaces of the photoconductor drums 4K, 4Y, 4M, 4 (while sticking out in a direction opposite to the rotational direction of the photoconductor drums 4K, 4Y, 4M, 4C). The photoconductor blades 26K, 26Y, 26M, 26C are made of, for example, an elastic body of polyurethane or the like.

(Transfer Unit 104)

The transfer unit 104, for example, includes: a conveyance belt 18; a driving roller 17 that drives the conveyance belt 18; a driven roller 16 that is driven by the driving roller 17; transfer rollers 10K, 10Y, 10M, 10C arranged to face the photoconductor drums 4K, 4Y, 4M, 4C with the conveyance belt 18 interposed in between; a belt blade 27; and a waste toner box 28.

The conveyance belt 18 is an endless elastic belt made of a resin material such as a polyimide resin. The conveyance belt 18 is installed (stretched) around the driving roller 17, the driven roller 16 and the transfer rollers 10K, 10Y, 10M, 10C, and circularly rotates in a direction indicated with an arrow in FIG. 1A. The driving roller 17 drives the conveyance belt 18 using a driving force from a conveyance belt motor 801 (discussed later). The transfer rollers 10K, 10Y, 10M, 10C are members that electrostatically transfer the toner images, formed in the image forming units 2K, 2Y, 2M, 2C, onto the record medium while conveying the record medium in the conveyance direction. The transfer rollers 10K, 10Y, 10M, 10C are made of a foamed semiconducting elastic rubber material. The driving roller 17, the driven roller 16 and the transfer rollers 10K, 10Y, 10M, 10C are substantially column-shaped rotatable members that transversely extend in a direction vertical to the sheet of paper on which FIG. 1A is drawn. The belt blade 27 is a member that cleans the conveyance belt 18 by scraping off waste toners remaining on the surface of the conveyance belt 18. The waste toner box 28 collects and stores the waste toners scraped off by the belt blade 27.

(Fixation Device 105)

The fixation device 105 is a member that applies heat and pressure to the toner images transferred onto the record medium conveyed from the transfer unit 104, and thereby fuses the toner images onto the record medium. The fixation device 105 includes, for example, a heater 55, a thermistor 792 and a fusing motor 793. The fixation device 105 is described in detail later.

(Delivery Unit 106)

The delivery unit 106 includes a position sensor 21, and delivery rollers 22, 23 arranged to face each other. The position sensor 21 detects the position of the record medium that is discharged from the fixation device 105 and is travelling in the conveyance passage P. The delivery rollers 22, 23 deliver the record medium, discharged from the fixation device 105, to the outside.

As illustrated in FIG. 1B, the image forming apparatus 1 includes a print controller 700, an I/F controller 710, a reception memory 720, an image data editing memory 730, an operation unit 701 and a sensor group 702. The image forming apparatus 1 further includes a charging voltage controller 740, a head driving controller 750, a developing voltage controller 760, a transfer voltage controller 770, an image formation driving controller 780, a fusing controller 790, a conveyance belt driving controller 800 and a sheet feeding/conveyance driving controller 810 which all receive instructions from the print controller 700.

The print controller 700 includes a microprocessor, an ROM, an RAM, as well as input and output ports. The print controller 700 controls all the process operations by the image forming apparatus 1, for example by executing predetermined programs. To put it specifically, upon receipt of print data and a control command from the I/F controller 710, the print controller 700 performs the print operation by controlling the charging voltage controller 740, the head driving controller 750, the developing voltage controller 760, the transfer voltage controller 770, the image formation driving controller 780, the fusing controller 790, the conveyance belt driving controller 800, and the sheet feeding/conveyance driving controller 810 in a coordinated manner.

The I/F controller 710 receives the print data and the control command from an external apparatus such as a personal computer (PC), or sends a signal representing the condition of the image forming apparatus 1.

The reception memory 720 temporarily stores the print data received from the external apparatus, such as a PC, via the I/F controller 710.

The image data editing memory 730 receives the print data stored in the reception memory 720, and stores image data obtained by editing the print data.

The operation unit 701, for example, includes: LED lamps that display information on the condition of the image forming apparatus 1 and the like; and an input device (buttons and a touch panel) through which the user gives instructions to the image forming apparatus.

The sensor group 702 includes various sensors that monitor the operating status of the image forming apparatus 1, for example, the position sensors 12, 13, 21 that detect the position of the record medium, a temperature sensor that detects the temperature inside the image forming apparatus 1, and a print density sensor.

Based on an instruction from the print controller 700, the charging voltage controller 740 performs control so as to: apply charging voltage to the charging rollers 5 (5K, 5Y, 5M, 5C); and thereby electrically charge the surfaces of the photoconductor drums 4 (4K, 4Y, 4M, 4C).

Depending on the image data stored in the image data editing memory 730, the head driving controller 750 performs control so as to make the LED heads 3 (3K, 3Y, 3M, 3C) perform their light-exposure operations.

Based on an instruction from the print controller 700, the developing voltage controller 760 performs control so as to: apply developing voltages to the developing rollers 6 (6K, 6Y, 6M, 6C); and thereby develop the toners on the electrostatic latent images formed on the surfaces of the photoconductor drums 4 (4K, 4Y, 4M, 4C).

Based on an instruction from the print controller 700, the transfer voltage controller 770 performs control so as to: apply transfer voltages to the transfer rollers 10 (10K, 10Y, 10M, 10C); and thereby transfer the toner images onto the record medium.

Based on an instruction from the print controller 700, the image formation driving controller 780 controls the drives of drive motors 781 to 784. The drive motors 781 to 784 rotationally drive the photoconductor drums 4 (4K, 4Y, 4M, 4C), the charging rollers 5 (5K, 5Y, 5M, 5C), and he developing rollers 6 (6K, 6Y, 6M, 6C).

Based on an instruction from the print controller 700, the fusing controller 790 controls the fusing operation of the fixation device 105. To put it specifically, the fusing controller 790 controls a voltage to be applied to the heater 55. Based on the temperature of the fixation device 105 measured by the thermistor 792, the fusing controller 790 controls the ON and OFF of the voltage to be applied to the heater 55. The fusing controller 790 further controls the operation of the fusing motor 793.

Based on an instruction from the print controller 700, the conveyance belt driving controller 800 controls the operation of the conveyance belt motor 801 provided in the image forming apparatus 1. The conveyance belt motor 801 drives the conveyance belt 18.

Based on an instruction from the print controller 700, the sheet feeding/conveyance driving controller 810 controls the operations of a sheet feeding motor 811 and a conveyance motor 812 provided in the image forming apparatus 1.

[Configuration of Fixation Device 105]

Figure 2A:
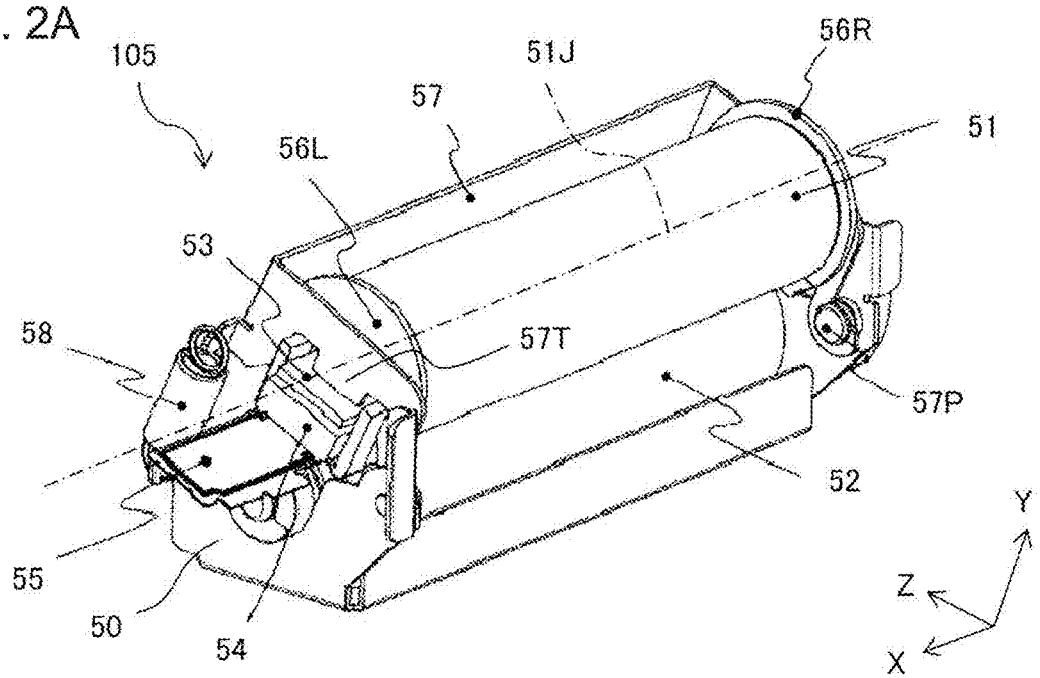
FIG. 2A is a magnified perspective view illustrating an external appearance of a fixation device illustrated in FIG. 1A.
Figure 2B:
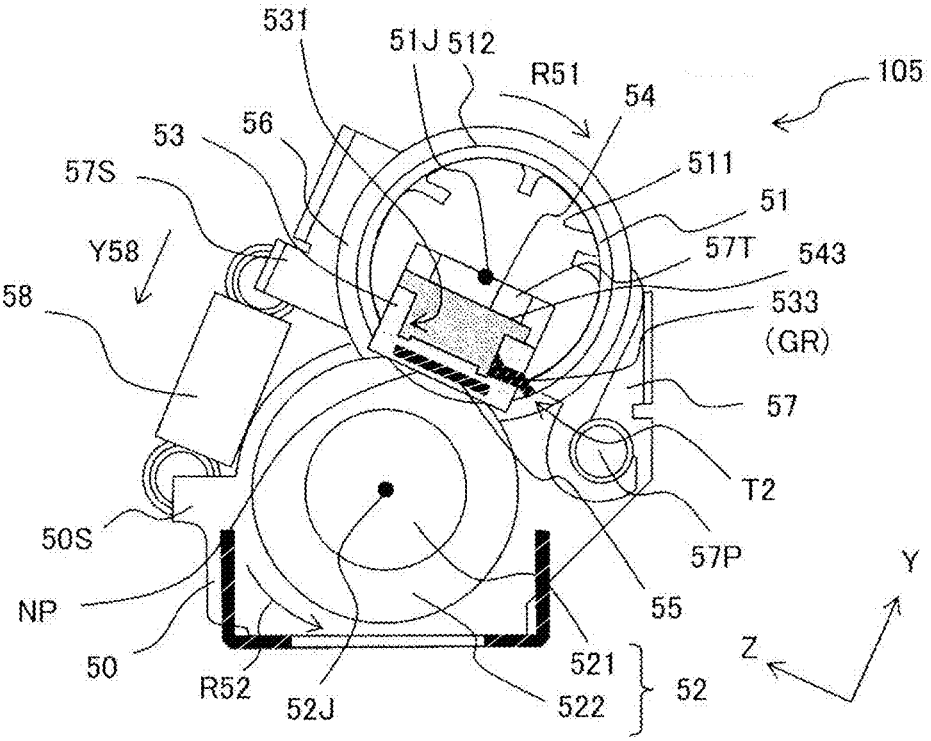
FIG. 2B is a cross-sectional view illustrating a cross-sectional structure of the fixation device illustrated in FIG. 1A.
Figure 3A:
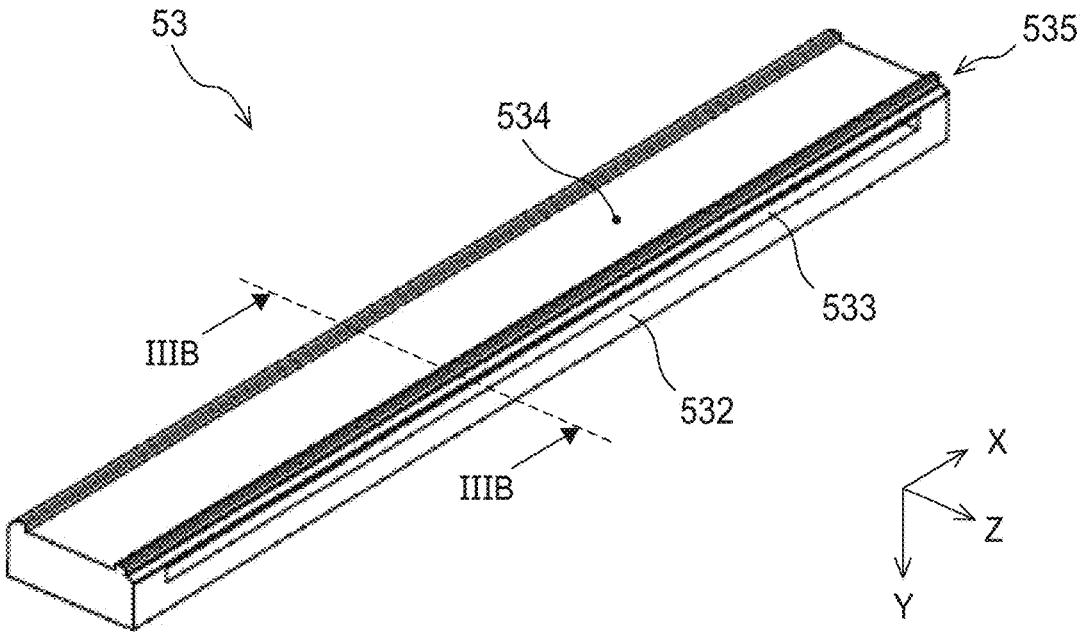
FIG. 3A is a magnified perspective view illustrating a component of the fixation device illustrated in FIG. 2A.
Figure 3B:
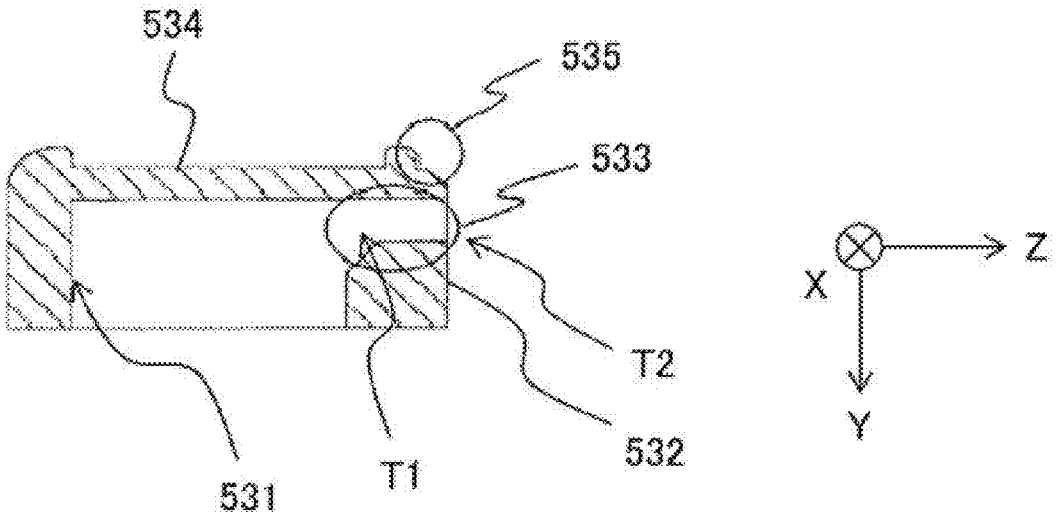
FIG. 3B is a cross-sectional view illustrating the component of the fixation device illustrated in FIG. 3A.
Figure 4:
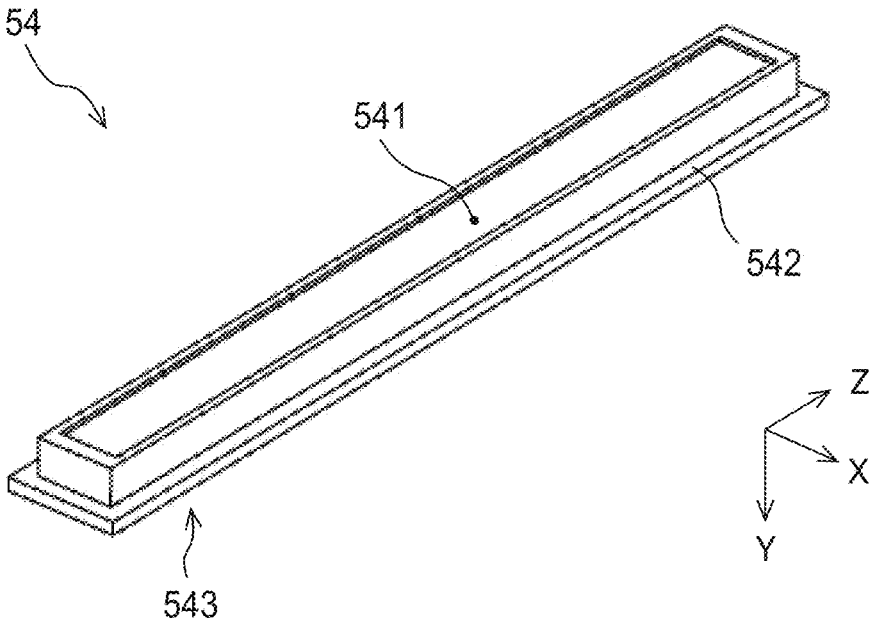
FIG. 4 is a magnified perspective view illustrating another component of the fixation device illustrated in FIG. 2A.

Next, referring to FIGS. 2A to 4A, descriptions are provided for a detailed configuration of the fixation device 105. FIG. 2A is a perspective view illustrating an external appearance of the fixation device 105 from an upstream side in the conveyance direction of the record medium. FIG. 2B is a cross-sectional view of the fixation device 105. FIG. 3A is a magnified perspective view illustrating a lubricant holding member 53 serving as a lubricant container (discussed later) which is a component of the fixation device 105. FIG. 3B is a cross-sectional view of the lubricant holding member 53 taken along the IIIB-IIIB line in FIG. 3A. FIG. 4 is a magnified perspective view illustrating a lubricant pressurizing member 54 which is another component of the fixation device 105.

The fixation device 105 includes, for example, a base member 50, a fixation belt 51, a pressure roller 52, the lubricant holding member 53, the lubricant pressurizing member 54, the heater 55, flanges 56 (56L, 56R), a lever member 57 and a biasing member 58. A lubricant GR is held between the lubricant holding member 53 and the lubricant pressurizing member 54. The lubricant GR is, for example, gel grease. The lubricant GR performs a function of: reducing frictional force among members by forming a thin oil film on the surfaces of the members to which the lubricant GR adheres; and enhancing their slidability.

The fixation belt 51 is an endless pipe-shaped elastic belt having an inner circumferential surface 511 and an outer circumferential surface 512. The fixation belt 51 is, for example, obtained by forming silicone rubber on an endless elastic belt made of a resin material such as a polyimide resin, or a substrate made of metal such as stainless steel. The fixation belt 51 is installed (stretched) around: the pair of flanges 56L, 56R provided at the two widthwise ends of the fixation belt 51; the heater 55 and the like. The fixation belt 51 is provided to be circularly rotatable around an axis 51J (FIGS. 2A and 2B) in a direction indicated with an arrow R51 in FIG. 2B (in FIG. 2B, rotatable to the right). To put it specifically, the fixation belt 51 is rotatably supported by the pair of flanges 56L, 56R that are fused at their two widthwise ends to the lever member 57. The outer circumferential surface 512 of the fixation belt 51 is biased by the biasing member 58 to contact the pressure roller 52 that faces the outer circumferential surface 512 in the Y-axis direction. Thereby, the outer circumferential surface 512 and the pressure roller 52 jointly form a nip section NP which extends on an XY plane (FIG. 2B). Due to frictional force between the fixation belt 51 and the pressure roller 52 in the nip section NP, the fixation belt 51 rotates in the direction indicated with the arrow R51 while following the rotation of the pressure roller 52. In this example, near the nip section NP, the fixation belt 51 moves in a +Z direction. The lubricant holding member 53, the lubricant pressurizing member 54, the heater 55 and the like are arranged inside a space surrounded by the fixation belt 51. Incidentally, the fixation belt 51 is a specific example of a "belt member" in this disclosure.

The pressure roller 52 is a column-shaped or cylinder-shaped object that extends in the X-axis direction. The pressure roller 52 is provided to be rotatable in a direction indicated with an arrow R52 (FIG. 2B) around an axis 52J that extends along the axis 51J. The pressure roller 52, for example, includes: a shaft 521 extending in the X-axis direction, and made of a rigid material such as a metal pipe; and an elastic layer 522 provided surrounding the shaft 521. The shaft 521 is rotatably supported near its two ends by the base member 50. The base member 50 is fused to a housing 100, for example. As illustrated in FIG. 2B, the pressure roller 52 contacts the outer circumferential surface 512 of the fixation belt 51. Thereby, the pressure roller 52 and the circumferential surface 512 jointly form the nip section NP. In this example, near the nip section NP, the pressure roller 52 moves in the +Z direction. The heater 55 is provided at a position where the heater 55 faces the pressure roller 52 with the fixation belt 51 interposed in between. Incidentally, the pressure roller 52 is a specific example of a "rotational member" in this disclosure.

The lever member 57 is attached to the base member 50 in a way that makes the base end of the lever member 57 turnable around a shaft 57P. A distal end portion 57S of the lever member 57 and a distal end portion 50S of the base member 50 are elastically connected to each other by the biasing member 58 such as a coil spring. The biasing member 58 biases the distal end portion 57S in a way that makes the distal end portion 57S come closer to the distal end portion 50S, that is to say, in a direction indicated with an arrow Y58 in FIG. 2B. Furthermore, the lever member 57 includes a contact portion 57T that is brought into contact with the lubricant pressurizing member 54. Incidentally, the biasing member 58 is a specific example of a "pressure member" or "biasing member" in this disclosure.

Figure 6:
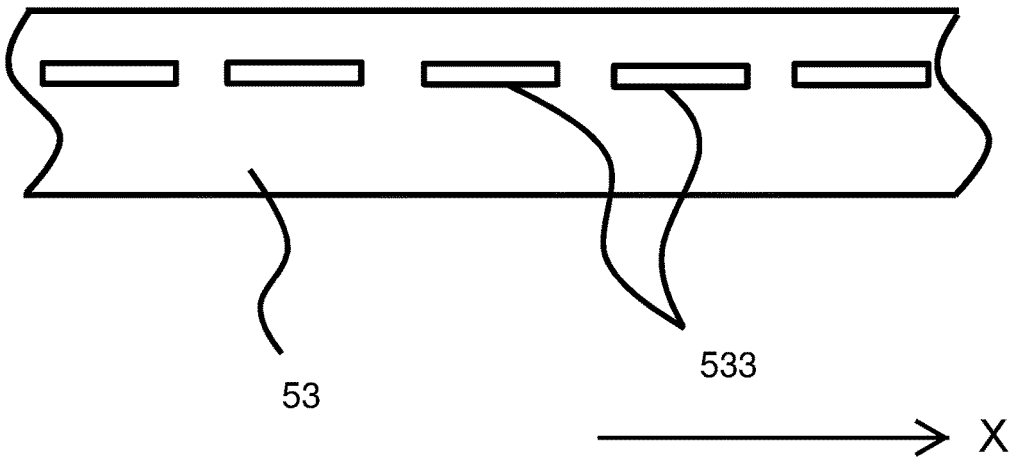
FIG. 6 is a schematic view illustrating a plurality of passages in a lubricant holding member according to a modification.

As illustrated in FIG. 3A, the lubricant holding member 53 is a substantially rectangular prism-shaped object that extends in the width direction (the X-axis direction). The width-direction dimension of the lubricant holding member 53 is substantially equal to that of the fixation belt 51, for example. The lubricant holding member 53 is fused to the pair of flanges 56L, 56R. Thereby, the lubricant holding member 53, the pair of flanges 56L, 56R, the lever member 57 and the fixation belt 51 are integrally displaceable relative to the pressure roller 52 supported by the base member 50. As illustrated in FIG. 3A, the lubricant holding member 53 includes: a lubricant holding portion 531 which is a recessed portion for holding the lubricant GR; an outer surface 532; and at least one passage 533 extending from the lubricant holding portion 531 to the outer surface 532. The lubricant GR, held in the lubricant holding portion 531, moves to the outer surface 532 via the passage 533 when pressurized by the lubricant pressurizing member 54. The passage 533 includes: a first end portion T1 exposed to the lubricant holding portion 531; and a second end portion T2 exposed to the outer surface 532. In this respect, an angle of rotation of the fixation belt 51 from the second end portion T2 to a section of contact between the outer surface 532 and the pressure roller 52 (or the nip section NP) in a direction of rotation of the fixation belt 51 (the direction indicated with the arrow R51) may be less than 180° . In other words, it is preferable that the second end portion T2 through which the lubricant GR is discharged be arranged immediately before the nip section NP in the direction of rotation of the fixation belt 51. The lubricant holding member 53 further includes a heater holding portion 534, arranged opposite from the lubricant holding portion 531, for holding the heater 55. The lubricant holding member 53 further includes an application amount adjuster 535 that is on the outer surface 532, and near the passage 533. The application amount adjuster 535 communicates with the second end portion T2 of the passage 533, and extends in the width direction (the X-axis direction). Thus, after flowing out from the passage 533 to the outer surface 532, the lubricant GR spreads in the width direction, and is temporality stored there. Incidentally, the passage 533 also may extend in the width direction. Otherwise, multiple passages 533 may be provided separately, for example, at predetermined intervals in the width direction of the belt 51 (see FIG. 6). In that case, the application amount adjuster 535 may be provided shared by the multiple passages 533. In other words, the application amount adjuster 535 may communicate with the second end portions T2 of the respective multiple passages 533.

As illustrated in FIG. 4, the lubricant pressurizing member 54 is a substantially rectangular prism-shaped object that extends in the width direction. The width-direction dimension of the lubricant pressurizing member 54 is substantially equal to that of the fixation belt 51. The lubricant pressurizing member 54 is provided to be displaceable relative to the lubricant holding member 53 along the Y-axis direction. The lubricant pressurizing member 54, for example, includes: a pressure section 541 that is inserted into the lubricant holding portion 531 of the lubricant holding member 53, contacts the lubricant GR held in the lubricant holding portion 531, and thereby pressurizes the lubricant GR; and a lock section 542 that is locked to a wall portion of the circumference of the lubricant holding portion 531. The lubricant pressurizing member 54 further includes a back surface 543 that comes into contact with the contact portion 57T of the lever member 57. When the back surface 543 comes into contact with the contact portion 57T of the lever member 57 and is thereby biased in a −Y direction by biasing force of the biasing member 58, the lubricant pressurizing member 54 is displaced in a way that makes the lubricant pressurizing member 54 come closer to the lubricant holding member 53.

It should be noted that: the lubricant holding member 53 is a specific example of a "lubricant holding member" in this disclosure; and the lubricant pressurizing member 54 is a specific example of a "lubricant pressurizing member" in this disclosure. In addition, the lubricant holding member 53 and the lubricant pressurizing member 54 jointly are a specific example of a "lubricant supply device" in this disclosure. The lubricant supply device including the lubricant holding member 53 and the lubricant pressurizing member 54 is provided inside the space surrounding by the fixation belt 51. The lubricant supply device including the lubricant holding member 53 and the lubricant pressurizing member 54 supplies the lubricant GR from the lubricant holding member 53 to a clearance between the inner circumferential surface 511 of the fixation belt 51 and the heater 55 via the passage 533.

The heater 55 is a flat plate-shaped member that heats the fixation belt 51, and includes a heating element controlled by the fusing controller 790. The heating element is, for example, a resistor line or the like that produces heat when supplied with electric current. The heater 55 is arranged to face the inner circumferential surface 511 of the fixation belt 51. The heater 55 is a specific example of a "heating member" in this disclosure.

As discussed above, in the fixation device 105, a first pressurizing direction in which the lubricant pressurizing member 54 pressurizes the lubricant GR and a second pressurizing direction in which the heater 55 and the fixation belt 51 pressurize the pressure roller 52 are the −Y direction, and substantially coincide with each other.

Furthermore, using the biasing force of the biasing member 58, the fixation device 105 makes the lubricant pressurizing member 54 pressurize the lubricant GR, and the heater 55 and the fixation belt 51 pressurize the pressure roller 52, as the single action.

[Method of Manufacturing Fixation Device 105]

A method of manufacturing the fixation device 105 is hereinbelow described using FIGS. 5A to 5F in addition to FIGS. 2A to 4.

Figure 5A:
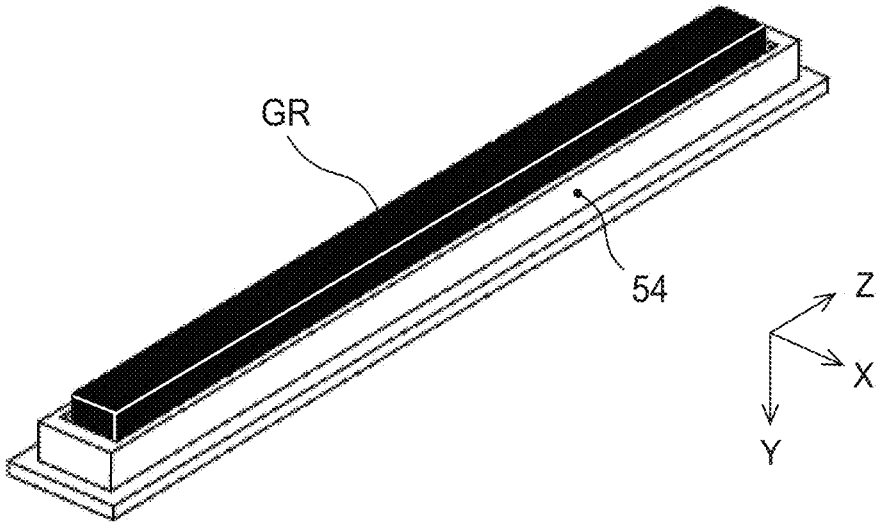
FIG. 5A is a perspective view illustrating a step included in a process of manufacturing the fixation device illustrated in FIG. 2A.

To begin with, as illustrated in FIG. 5A, the lubricant pressurizing member 54 is prepared, and the lubricant GR is applied onto the lubricant pressurizing member 54.

Figure 5B:
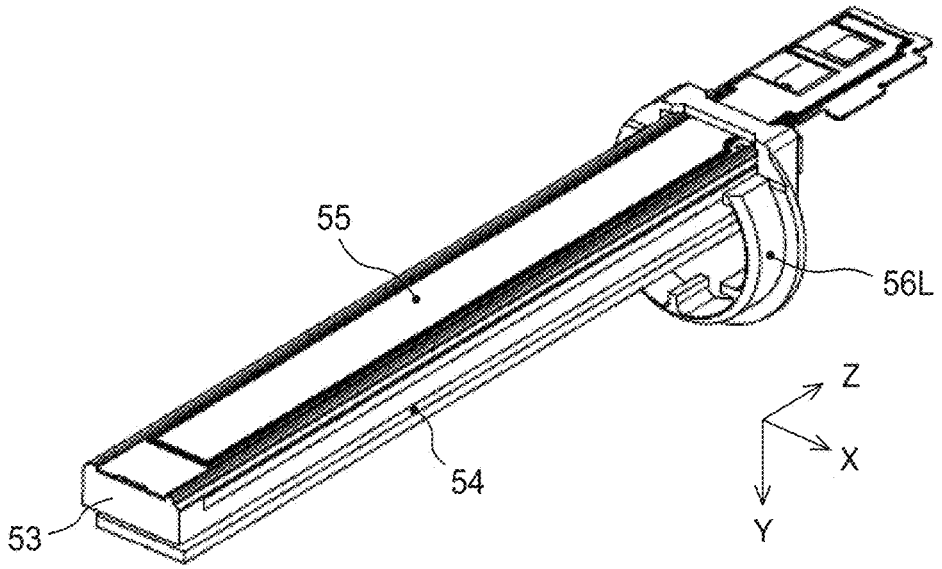
FIG. 5B is a perspective view illustrating a step following the step illustrated in FIG. 5A.

Next, as illustrated in FIG. 5B, the lubricant holding member 53 is placed on the lubricant pressurizing member 54 with the lubricant GR interposed between the lubricant holding member 53 and the pressure section 541. Thereafter, the heater 55 is placed in the heater holding portion 534 of the lubricant holding member 53. Then, the flange 56L is attached to one ends of the lubricant pressurizing member 54 and the lubricant holding member 53.

Figure 5C:
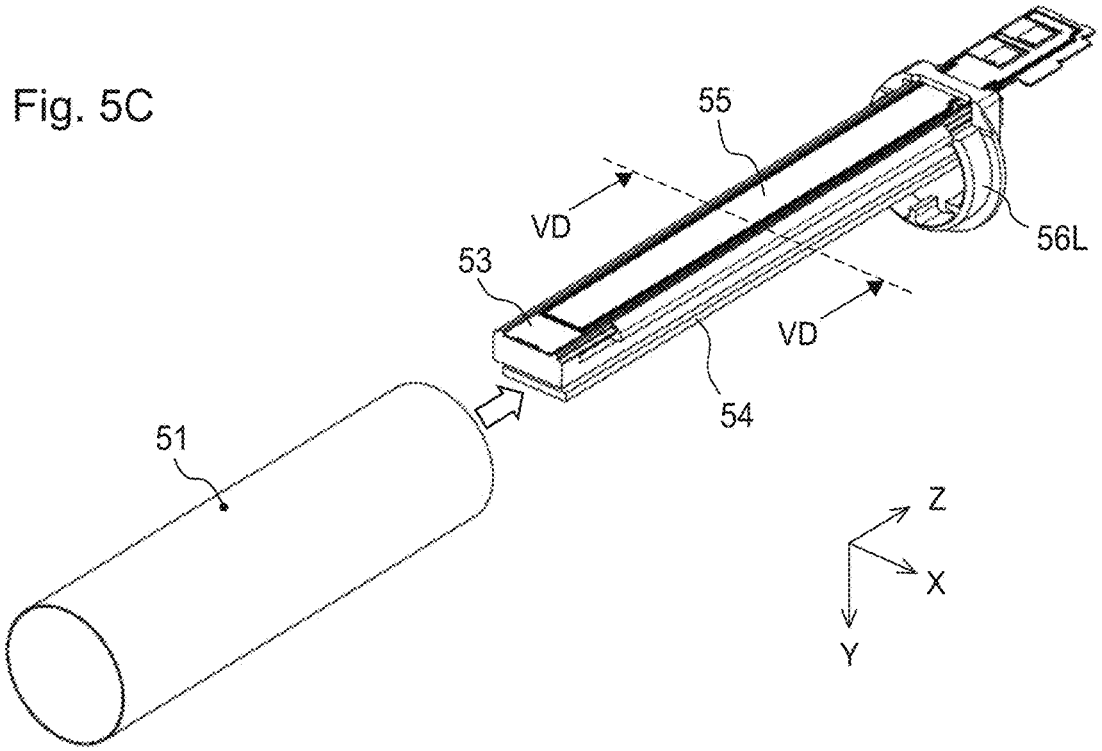
FIG. 5C is a perspective view illustrating a step following the step illustrated in FIG. 5B.
Figure 5D:
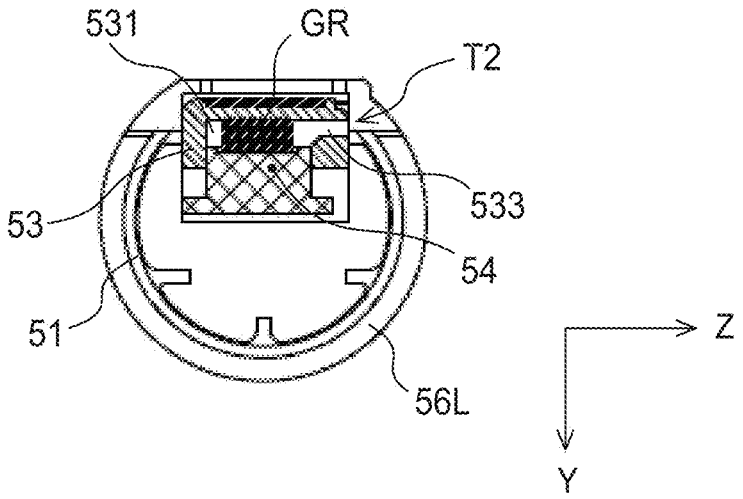
FIG. 5D is a cross-sectional view illustrating a step following the step illustrated in FIG. 5C.

Subsequently, as illustrated in FIG. 5C, from the side of the other ends of the lubricant pressurizing member 54 and the lubricant holding member 53, the fixation belt 51 is attached to the lubricant pressurizing member 54 and the lubricant holding member 53 in a way that makes the fixation belt 51 accommodate the heater 55, the lubricant pressurizing member 54 and the lubricant holding member 53. FIG. 5D illustrates a cross section of the fixation device 105 at the stage where the fixation belt 51 is attached to the fixation device 105. FIG. 5D is a cross-sectional view of the fixation device 105 taken along the VD-VD line in FIG. 5C. In this stage, the lubricant GR between the lubricant pressurizing member 54 and the lubricant holding member 53 stays in the lubricant holding portion 531, and the passage 533 is accordingly a vacant space.

Figure 5E:
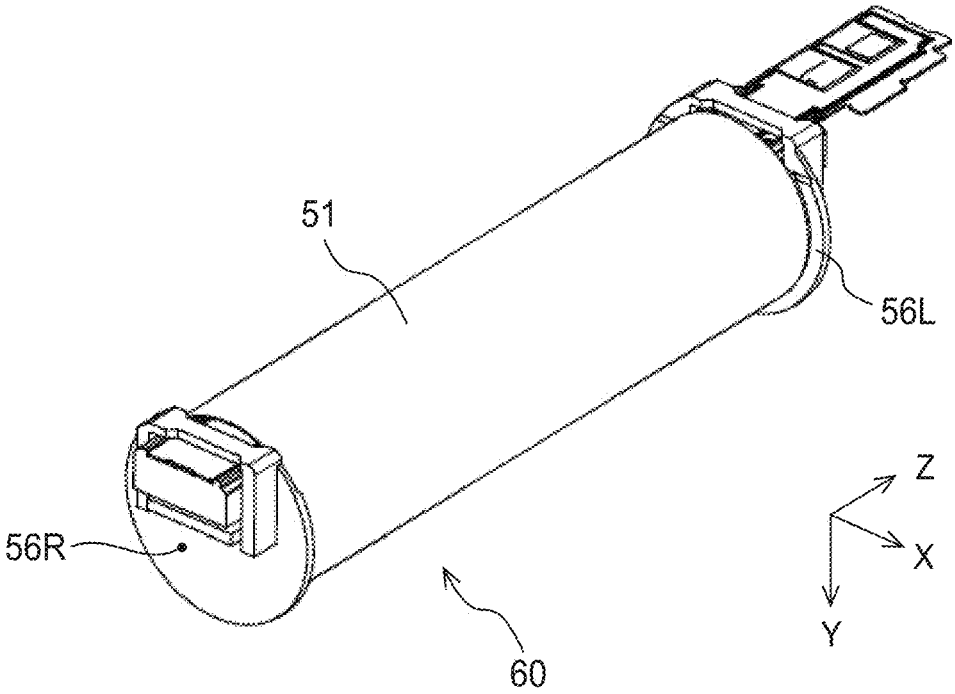
FIG. 5E is a perspective view illustrating a step following the step illustrated in FIG. 5D.

As illustrated in FIG. 5E, the flange 56R is attached to the other ends of the lubricant pressurizing member 54 and the lubricant holding member 53 after the fixation belt 51 is attached to the fixation device 105. With this, a belt assembly 60 is completed.

Figure 5F:
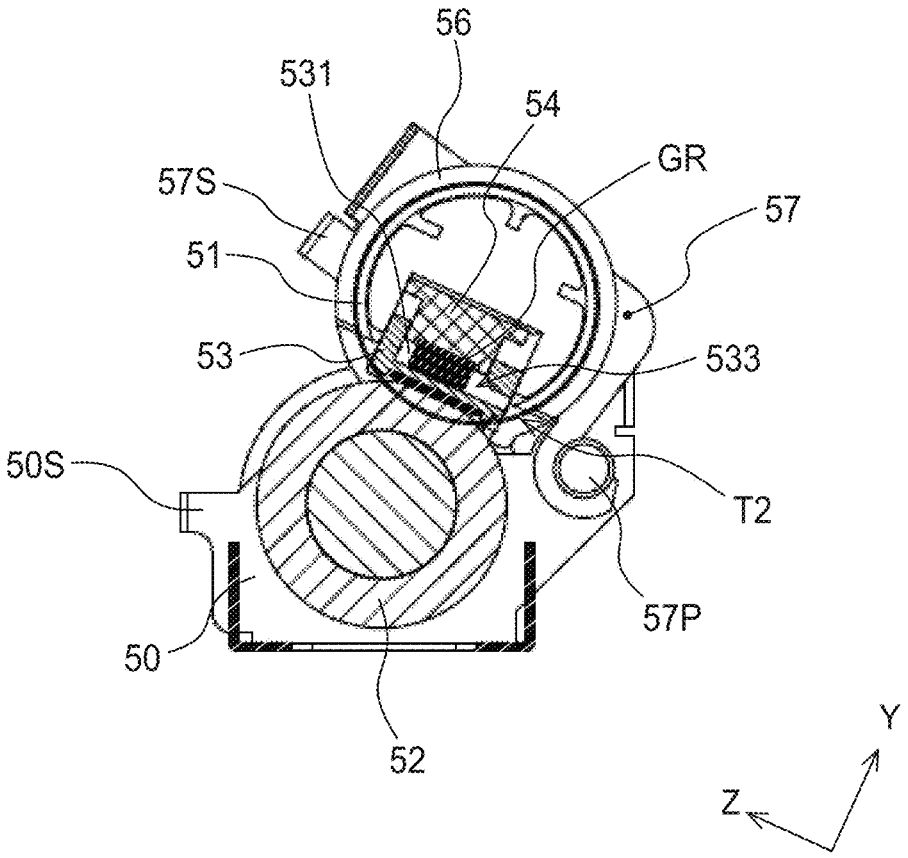
FIG. 5F is a cross-sectional view illustrating a step following the step illustrated in FIG. 5E.

Thereafter, the belt assembly 60 is attached to the lever member 57. After that, as illustrated in FIG. 5F, the belt assembly 60 is attached to the base member 50 supporting the pressure roller 52 through the shaft 57P. In this stage, too, the lubricant GR between the lubricant pressurizing member 54 and the lubricant holding member 53 still stays in the lubricant holding portion 531, and the passage 533 is accordingly a vacant space.

Finally, as illustrated in FIG. 2B, the biasing member 58 is attached in a way that the biasing member 58 connects the distal end portion 50S and the distal end portion 57S. Thereby, the fixation device 105 is completed. In this respect, once the biasing member 58 is attached to them, the biasing force of the biasing member 58 makes the contact portion 57T of the lever member 57 push the back surface 543 of the lubricant pressurizing member 54 toward the lubricant holding member 53 in the −Y direction. Thus, the lubricant GR held in the lubricant holding portion 531 is pressurized by the pressure section 541 of the lubricant pressurizing member 54, flows from the lubricant holding portion 531, passes through the passage 533, reaches the second end portions T2, and eventually is pushed out into the clearance between the heater 55 and the inner circumferential surface 511 of the fixation belt 51. Also, the biasing force of the biasing member 58 biases the flanges 56 and the lubricant holding member 53, fused to the lever member 57, in a direction toward the pressure roller 52 (the −Y direction). Thus, the fixation belt 51 rotatably attached to the heater 55 provided in the heater holding portion 534 of the lubricant holding member 53 and the flanges 56 pressurizes the pressure roller 52 in the −Y direction. Hence, the fixation belt 51 and the pressure roller 52 jointly form the nip section NP. As discussed above, in the assembling stage, using the biasing force of the biasing member 58, the fixation device 105 makes the lubricant pressurizing member 54 pressurize the lubricant GR, and the heater 55 and the fixation belt 51 pressurize the pressure roller 52, in a linked manner as a single action.

[Operation and Effects]

(A. Basic Operation)

The image forming apparatus 1 transfers the toner images onto the record medium in the following way.

To put it specifically, as illustrated in FIG. 1A, to begin with, the sheet feeding roller 11 picks up the record media, accommodated in the sheet cassette 24, one by one from their top, and sends out each record medium toward the medium conveyance unit 102 located downstream of the sheet feeding roller 11. Thereafter, the medium conveyance unit 102 conveys the record medium, sent out by the sheet feeding roller 11, to the image forming section 103 and the transfer unit 104, located downstream of the medium conveyance unit 102, while correcting the skewing of the record medium. The image forming section 103 and the transfer unit 104 transfer the toner images onto the record medium in the following way.

Once data on a print image and a print command are inputted into the print controller 700 in the activated image forming apparatus 1 from the external apparatus such as the PC via the I/F controller 710, the print controller 700 starts the operation of printing the data on the print image in cooperation with the image formation driving controller 780, depending on the print command.

The image formation driving controller 780 drives the drive motors 781 to 784, and thereby rotates the photoconductor drums 4K, 4Y, 4M, 4C in the predetermined direction at a certain speed. Once the photoconductor drums 4K, 4Y, 4M, 4C rotate, their driving forces are transmitted to the toner supplying sponge rollers 9K, 9Y, 9M, 9C, the developing rollers 6K, 6Y, 6M, 6C and the charging rollers 5K, 5Y, 5M, 5C via drive transmission units such as gear trains, respectively. Thus, the toner supplying sponge rollers 9K, 9Y, 9M, 9C, the developing rollers 6K, 6Y, 6M, 6C and the charging rollers 5K, 5Y, 5M, 5C rotate in their respective predetermined directions.

Meanwhile, based on an instruction from the print controller 700, the charging voltage controller 740 applies predetermined voltages to the charging rollers 5K, 5Y, 5M, 5C, and thereby evenly charge the surfaces of the photoconductor drums 4K, 4Y, 4M, 4C.

Next, the head driving controller 750 activates the LED heads 3K, 3Y, 3M, 3C, thereby emits light, corresponding to the print image, onto the photoconductor drums 4K, 4Y, 4M, 4C based on the image signal, and thus forms the electrostatic latent images on the surfaces of the photoconductor drums 4K, 4Y, 4M, 4C. Furthermore, the toners are supplied from the toner tanks 7K, 7Y, 7M, 7C to the toner supplying sponge rollers 9K, 9Y, 9M, 9C. The toners are carried by the toner supplying sponge rollers 9K, 9Y, 9M, 9C, and move to near the developing rollers 6K, 6Y, 6M, 6C in response to the rotations of the toner supplying sponge rollers 9K, 9Y, 9M, 9C. At this time, the toners are negatively charged, for example, depending on potential differences between the electrical potentials of the developing rollers 6K, 6Y, 6M, 6C and the electrical potentials of the toner supplying sponge rollers 9K, 9Y, 9M, 9C, and are supplied to the developing rollers 6K, 6Y, 6M, 6C. The toners supplied to the developing rollers 6K, 6Y, 6M, 6C form the toner layers that are restricted to have predetermined thicknesses by the developing blades 8K, 8Y, 8M, 8C.

Thereafter, depending on the electrostatic latent images formed on the surfaces of the photoconductor drums 4K, 4Y, 4M, 4C, the toner layers on the developing rollers 6K, 6Y, 6M, 6C are developed. Thereby, the toner images are formed on the photoconductor drums 4K, 4Y, 4M, 4C. The resultant toner images are transferred onto the record medium due to electric fields between the photoconductor drums 4K, 4Y, 4M, 4C and the transfer rollers 10K, 10Y, 10M, 10C which are arranged to face the photoconductor drums 4K, 4Y, 4M, 4C, and to which predetermined voltages are applied by the transfer voltage controller 770.

After that, the fixation device 105 applies heat and pressure to the toner images transferred onto the record medium, and thereby fuses the toner images onto the record medium. Subsequently, the record medium with the toner images fused thereon is delivered to the outside by the delivery unit 106. Incidentally, there is a case where toners that have not been transferred to the record medium remain on the photoconductor drums 4K, 4Y, 4M, 4C in slight amounts. The residual toners are removed by the photoconductor blades 26K, 26Y, 26M, 26C. Thus, the photoconductor drums 4K, 4Y, 4M, 4C can be used continuously.

(B. Operation of Fixation Device 105)

Based on an instruction from the print controller 700, the fixation device 105 performs the process of fusing the toner images onto the record medium under the control of the fusing controller 790. To put it specifically, under the control of the fusing controller 790, an electric current is supplied to the heater 55 to heat the fixation belt 51, and the fusing motor 793 is activated to start the rotation of the pressure roller 52. In response to the rotation of the pressure roller 52, the fixation belt 51 in contact with the pressure roller 52 in the nip section NP also starts its rotation by following the rotation of the pressure roller 52. Once the fixation belt 51 starts its rotation, the lubricant GR pushed out from the second end portion T2 to the clearance between the heater 55 and the inner circumferential surface 511 of the fixation belt 51 moves along the inner circumferential surface 511 in the circumferential direction, and spreads in the width direction while accumulating in the application amount adjuster 535. The further continuation of the rotation of the fixation belt 51 makes the lubricant GR substantially evenly applied onto the entirety of the inner circumferential surface 511 eventually. Thus, the function of the thin oil film formed of the lubricant GR reduces the frictional force produced between the heater 55 and the inner circumferential surface 511 of the fixation belt 51. This enhances the slidability of the fixation belt 51 over the heater 55, and stabilizes the rotation of the fixation belt 51.

(C. Effects)

As discussed above, the lubricant GR held in the lubricant holding portion 531 in the lubricant supply device is pressurized by the lubricant pressurizing member 54, and the lubricant GR is thereby supplied to the clearance between the inner circumferential surface 511 of the fixation belt 51 and the heater 55 via the passage 533. In other words, the fixation device 105 has a structure which makes the lubricant GR less likely to be exposed to the outside while the fixation device 105 is being assembled, and is accordingly easy to handle. To put it specifically, in the process of manufacturing the fixation device 105, the lubricant GR held in the lubricant holding portion 531 is pushed out to the outer surface 532 in the stage of attaching the biasing member 58 to the fixation device 105. For this reason, manufacturing workers and the like do not touch the lubricant GR in the stage of assembling the lubricant supply device, or in the stage of attaching the flanges 56 and the fixation belt 51. This makes it possible to obtain excellent manufacturing workability.

Furthermore, the fixation device 105 avoids a reduction in the lubricant GR which would otherwise occurs if the lubricant GR adhered to other members, the hands of the manufacturing workers, and so on in the manufacturing process. Thus, while the fixation device 105 is in operation, an appropriate amount of lubricant is supplied to the clearance between the inner circumferential surface of the belt member and the heating member. This makes the fixation belt 51 rotate smoothly. Accordingly, the image forming apparatus 1 is capable of achieving images with higher quality for a long time.

Moreover, in the fixation device 105, the angle of rotation of the fixation belt 51 from the second end portion T2 to the nip section NP in the direction of rotation of the fixation belt 51 is set less than 180°. In other words, the second end portion T2 through which the lubricant GR is discharged is arranged immediately before the nip section NP in the direction of rotation of the fixation belt 51. This makes it possible to effectively enhance the slidability of the fixation belt 51 over the heater 55 in the nip section NP where the frictional force is larger than in any other section.

In addition, in the fixation device 105, the application amount adjuster 535 provided on the outer surface 532 of the lubricant holding member 53, but near the second end portion T2 of the passage 533 of the lubricant holding member 53. This makes it possible to temporarily store the lubricant GR, flowed out from the passage 533 to the outer surface 532, while spreading the lubricant GR in the width direction, and accordingly to apply the lubricant GR onto the inner circumferential surface 511 more evenly in the width direction. Thus, the slidability of the fixation belt 51 over the heater 55 can be enhanced more.

Besides, in the fixation device 105, the first pressurizing direction in which the lubricant pressurizing member 54 pressurizes the lubricant GR and the second pressurizing direction in which the heater 55 and the fixation belt 51 pressurize the pressure roller 52 are the −Y direction, and substantially coincide with each other. This makes it possible to make the lubricant pressurizing member 54, as well as the heater 55 and the fixation belt 51 to share the same force-providing structure, and thus to simplify the overall configuration. Accordingly, this is suitable to reduce the size and weight of the fixation device 105. Particularly, using the biasing force of the biasing member 58, the fixation device 105 makes the lubricant pressurizing member 54 pressurize the lubricant GR, and the heater 55 and the fixation belt 51 pressurize the pressure roller 52, in a linked manner as the single action. This makes it possible to achieve further simplification of the structure.

<2. Modifications>

The invention is not limited to the above-discussed embodiment, and can be variously modified. Although, for example, the foregoing embodiment has discussed the image forming apparatus that forms color images, the invention is not limited to this. The invention may be applicable to, for example, an image forming apparatus that forms monochrome images by transferring only black toner images. Furthermore, although the foregoing embodiment has discussed the image forming apparatus that employs the direct transfer method, the invention may be applicable to an image forming apparatus that employs the intermediate transfer method.

In addition, although the foregoing embodiment uses the gel grease as the lubricant GR, the lubricant usable in the disclosure is not limited to the gel grease. For example, the lubricant may be liquid silicone oil as long as the liquid silicone oil is absorbed into an absorbing material (cloth or the like) and the resultant material is retained between the lubricant holding member 53 and the lubricant pressurizing member 54.

Furthermore, although the foregoing embodiment uses the pressure roller 52 as the rotational member that forms the nip section NP in cooperation with the fixation belt 51, the rotational member of the disclosure is not limited to the pressure roller 52. For example, a belt member similar to the fixation belt 51 may be used as the rotational member as long as the belt member is stretched between the rollers or the like.

Moreover, although the foregoing embodiment makes the lubricant pressurizing member 54 pressurize the lubricant GR, and the heater 55 and the fixation belt 51 pressurize the pressure roller 52, in the linked manner using the biasing member 58, the two pressurizations may be performed individually.

Besides, although the foregoing embodiment uses the plate-shaped heater 55, including the heating element of a resistor line or the like, as the heat source for the fixation device 105, a halogen lamp may be used as the heat source instead of the heater 55. Furthermore, a pressure pad that biases the inner circumferential surface 511 of the fixation belt 51 may be additionally included to form the nip section NP.

Moreover, although the foregoing embodiment uses the LED head, whose light source is a light-emitting diode, as each exposure device, an exposure device whose light source is a laser element or the like may be used.

What is more, although the foregoing embodiment and the like have discussed the image forming apparatus having the printing function as one specific example of the "image forming apparatus", the "image forming apparatus" is not limited to the image forming apparatus having the printing function. In other words, the invention is also applicable, for example, to an image forming apparatus that functions as a multifunctional apparatus having a scanner function and a facsimile function in addition to the above-discussed printing function.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixation device comprising:

a belt member having a tubular shape with an inner circumferential surface and an outer circumferential surface, and provided to be rotatable;

a heating member arranged to face the inner circumferential surface of the belt member;

a lubricant supply device including a lubricant holding member that includes a lubricant holding portion that holds a lubricant, an outer surface, and at least one passage extending from the lubricant holding portion to the outer surface, and a lubricant pressurizing member that pressurizes the lubricant held in the lubricant holding portion;

a biasing member applying a biasing force causing the lubricant pressurizing member to pressurize the lubricant; and a rotational member provided being rotatable and configured to contact with the outer circumferential surface of the belt member.

2. The fixation device according to claim 1, wherein the heating member and the rotational member are arranged to face each other with the belt member interposed in between.

3. The fixation device according to claim 2, wherein a first pressurizing direction in which the lubricant pressurizing member pressurizes the lubricant and a second pressurizing direction in which the heating member and the belt member pressurize the rotational member coincide with each other.

4. The fixation device according to claim 2, wherein, the bias member makes the lubricant pressurizing member pressurize the lubricant, and makes the heating member and the belt member pressurize the rotational member.

5. The fixation device according to claim 1, wherein the lubricant supply device is provided inside a space surrounded by the belt member.

6. The fixation device according to claim 1, wherein each of the at least on passage includes a first end portion exposed to the lubricant holding portion, and a second end portion exposed to the outer surface, and a rotational angle, about a rotational axis of the belt member, from the second end portion to a contact between the outer circumferential surface of the belt member and the rotational member in a direction of rotation of the belt member is less than 180°.

7. The fixation device according to claim 1, wherein the at least one passage comprises a plurality of passages that are arranged along a width direction of the belt member.

8. The fixation device according to claim 1, wherein each of the at least on passage includes a first end portion exposed to the lubricant holding portion, and a second end portion exposed to the outer surface, and the second end portion communicates with an application amount adjuster that extends along a width direction of the belt member.

9. An image forming apparatus comprising the fixation device according to claim 1.

* * * * *